United States Patent [19]

Liontonia

[11] 4,282,402

[45] Aug. 4, 1981

[54] DESIGN OF CROSSOVER NETWORK FOR HIGH FIDELITY SPEAKER SYSTEM

[76] Inventor: Harry D. Liontonia, 6 N. Perkins Ave., Elmsford, N.Y. 10523

[21] Appl. No.: 32,163

[22] Filed: Apr. 23, 1979

[51] Int. Cl.[3] ..... H04R 3/14

[52] U.S. Cl. ..... 179/1 D

[58] Field of Search ..... 179/1 D, 1 E; 333/28 T

[56] References Cited

U.S. PATENT DOCUMENTS

| | | | |
|---|---|---|---|
| 2,612,558 | 9/1952 | Klipsch | 179/1 D |
| 3,838,215 | 9/1974 | Haynes, Jr. | 179/1 D |
| 4,015,089 | 3/1977 | Ishii et al. | 179/1 D |
| 4,031,321 | 6/1977 | Bakgaard | 179/1 D |
| 4,074,070 | 2/1978 | Gaus | 179/1 D |
| 4,138,594 | 2/1979 | Klipsch | 179/1 E |

OTHER PUBLICATIONS

Crowhurst; High Fidelity Sound Engineering; 1961.

*Primary Examiner*—Bernard Konick
*Assistant Examiner*—Randall P. Myers
*Attorney, Agent, or Firm*—Ostrolenk, Faber, Gerb & Soffen

[57] ABSTRACT

A filter network is interposed between an audio amplifier and a speaker system consisting of a woofer, midrange and tweeter. The reactive elements for the filter sections associated with the woofer, midrange and tweeter, respectively, are interrelated by mathematical formulas and there is a capacitor lock connected across the input terminals of the network. The value of the capacitor lock is mathematically related to the values of the reactive elements to achieve superior overall performance for the speaker system. The filter or crossover network is designed for matched or unmatched speakers. This design uses a frequency system based on $F_1$, $F_2=8F_1$ and $F_3=16F_1$, where $F_1$ is a selected frequency in the lower portion of the audio spectrum.

12 Claims, 1 Drawing Figure

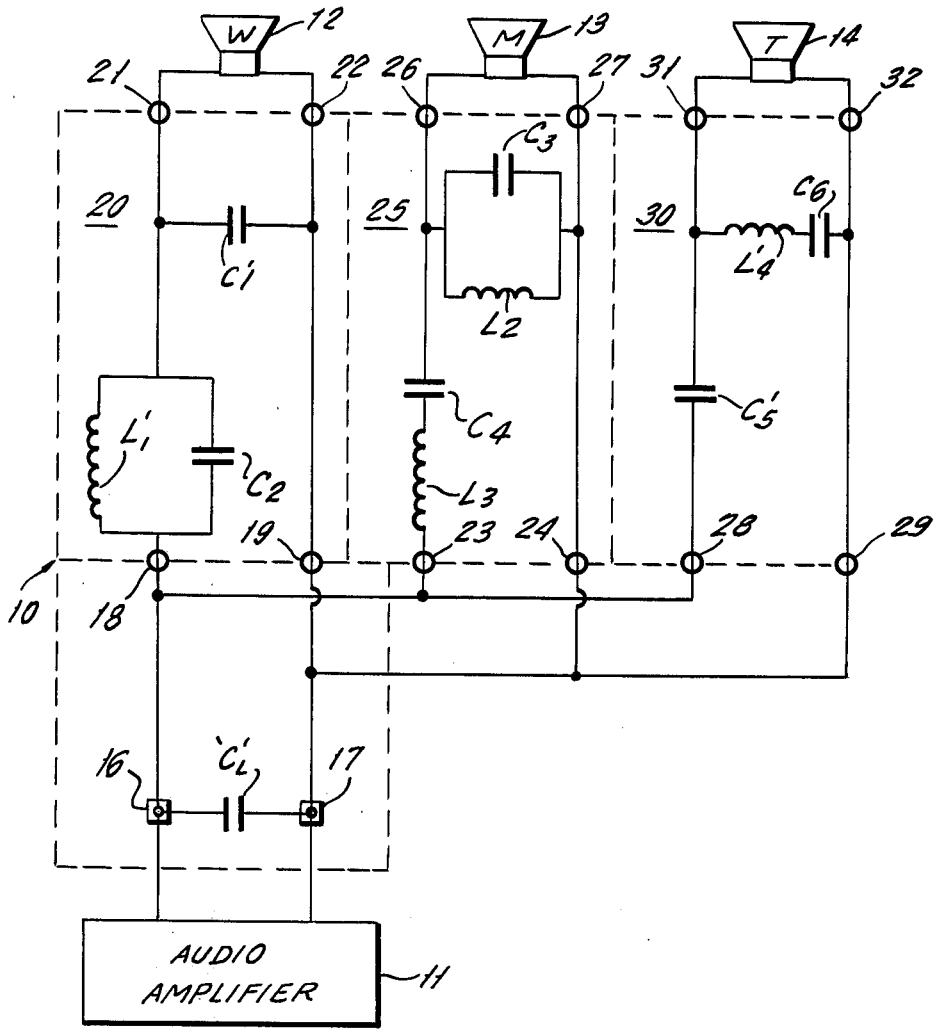
W
12
M
13
T
14
21
22
26
27
31
32
20
25
30
C3
C6
C1
L4
L2
L1
C2
C4
C5
L3
19
23
24
28
29
10
18
16
CL
17
AUDIO
AMPLIFIER
11

DESIGN OF CROSSOVER NETWORK FOR HIGH FIDELITY SPEAKER SYSTEM

This invention relates to audio output systems in general and more particularly relates to the construction of a crossover filter network for a high fidelity three speaker system. Disclosure Document No. 070857 filed in the U.S. patent and Trademark Office May 17, 1978 contains a description of this invention.

Typically, each channel of a high fidelity audio system is provided with three speakers each designed to function best over a different portion of the audio frequency spectrum. In particular, the speaker for the low portion of the spectrum is designated as the woofer, for the middle portion of the spectrum the speaker is designated as the midrange and for the high portion of the spectrum the speaker is designated as the tweeter. A crossover network is interposed between these speakers and the audio amplifier so that the frequency of the signals fed to each of the speakers will be compatible with its frequency capability.

In the prior art the crossover filter network often consisted of three filter sections each feeding a different one of the speakers. The reactive elements for each of the filter sections were chosen to be compatible with the speaker impedance and speaker sound reproducing capabilities, being based on crossover points. However, the values for the reactive elements of one filter section were essentially independent of the values of reactive elements in each of the other filter sections.

Pursuant to the instant invention a crossover filter network for feeding a three speaker high fidelity system is designed by utilizing mathematical formulas which are based on the realization that superior overall performance of the audio system is obtained by having the values of the reactive elements in each of the filter sections bear a predetermined relationship with the reactive elements in the other filter sections. Selection of these reactive elements is not constrained by selected crossover points but by mathematical relationships based on a selected starting frequency $F_1$ and related frequencies $F_2=8F_1$ and $F_3=16F_1$. In addition, there is a capacitor lock which is connected to the input terminals of the filter network, with this capacitor lock having a value determined by a mathematical formula which relates the value of the capacitor lock to values of the reactive elements in the filter sections.

Accordingly, a primary object of the instant invention is to provide a novel crossover filter network which achieves improved overall performance for a high fidelity audio system.

Another object is to provide a crossover filter network of this type in which the reactive elements of the various filter sections are mathematically related.

Still another object is to provide a crossover filter network of this type including a capacitor lock across the input terminals of the network, with this capacitor lock having a value related mathematically to the reactive elements of the filter sections.

A futher object is to provide a crossover filter network of this type which achieves improved sound reproduction without distortion over a wide volume range.

A still further object is to provide a crossover filter network of this type wherein changes in volume will not result in loss of fidelity, particularly so in the high band at high volume, or in the low band at low volume.

Yet another object is to provide a crossover filter network of this type suitable for use with speakers of either matched or unmatched impedances.

These objects as well as other objects of the instant invention shall become readily apparent after reading the following description of the single FIGURE which is an electrical schematic of a crossover filter network constructed in accordance with teachings of the instant invention and interposed between an audio amplifier and a three speaker system.

Now referring to the FIGURE which shows crossover filter network 10 interposed between the output of audio amplifier 11 and a three speaker system consisting of woofer 12, midrange 13 and tweeter 14. As is well known to the high fidelity art, woofer 12 functions best in the frequency band at the low end of the audio frequency spectrum, tweeter 14 functions best in the high frequency band at the high end of the audio frequency spectrum, and midrange 13 functions best in the frequency band between said high and low bands.

Input terminals 16, 17 of filter network 10 are connected to the output of audio amplifier 11 as well as being connected to the three sets of input terminals 18–19, 23–24, and 28–29 for the respective sections 20, 25 and 30 of crossover filter network 10. Output terminals 21, 22 of filter section 20 are connected to woofer 12, output terminals 26, 27 of filter section 25 are connected to midrange 13 and output terminals 31, 32 of filter section 30 are connected to tweeter 14.

Filter section 20 consists of capacitors $C'_1$ and $C_2$ and inductor $L'_1$. Capacitor $C'_1$ is connected across output terminals 21, 22 to shunt high frequency signals around woofer 12. Capacitor $C_2$ and inductor $L'_1$ are in a parallel combination connected in series between input terminals 18 and output terminal 21.

Filter section 25 consists of capacitors $C_3$ and $C_4$ and inductors $L_2$ and $L_3$. Capacitor $C_3$ and inductor $L_2$ are in parallel combination connected between output terminals 26, 27 while capacitor $C_4$ and inductor $L_3$ are in a series combination connected in series between input terminal 23 and output terminal 26.

Filter section 30 consists of capacitors $C'_5$ and $C_6$ and inductor $L'_4$. Capacitor $C'_5$ is connected in series in the circuit between input terminal 28 and output terminal 31, while capacitor $C_6$ and inductor $L'_4$ are in a series combination connected between output terminals 31, 32. Capacitor lock '$C'_L$ is connected directly across input terminals 16, 17 for crossover filter network 10.

Improved overall system performance is obtained by having the reactive elements of all three filter sections 20, 25 and 30 as well as lock capacitor means or capacitor lock '$C'_L$ related in a predetermined manner. That is, the values of these reactive elements in this so-called $F_1$ system are calculated by utilizing the mathematical formulas which follow. These formulas are accurate for all full eight (8) ohm speakers.

In the equations which follow, $F_1$ is a nominal starting frequency typically selected from the low frequency band (that band best reproduced by woofer 12). A suitable frequency for $F_1$ is 400 Hz. $F_2=8F_1$, $F_3=16F_1$.

In woofer filter section 20:

$$L_1 = \frac{F_2 - [F_3(F_1F_2)^{\frac{1}{2}}]^{\frac{1}{2}}}{(F_1)^2}$$

$L'_1 = m_w L_1$, where the constant $M_w = [1 - (F_1/F_2)^2]^{\frac{1}{2}} = 0.99215$, $C_1 = [(2\pi F_1)^2 L_1]^{-1}$, $C'_1 = m_w C_1$, and -continued $$C_2 = [(2\pi F_2)^2 L'_1]^{-1}.$$

In midrange filter section 25 feeding wide or full range speaker 13:

$$F_o = (F_1 F_3)^{\frac{1}{2}}$$
$$C_3 = \{ \{[F_1(F_3 - F_1)]^{\frac{1}{2}} 2\pi\}^2 - L_1\}^{-1}$$
$$L_2 = [(2\pi F_o)^2 C_3]^{-1}$$
$$C_4 = \{ \{[(F_o)^2/(F_3 - F_1)]2\pi\}^2 L_2\}^{-1}, \text{ and}$$
$$L_3 = [(2\pi F_o)^2 C_4]^{-1}{}_o$$

In tweeter filter section 30:

$$F_4 = (F_1 + F_2 + F_3) = 25\,F_1 \text{ (See "Proof" below) and}$$
$$\text{CONSTANT } m_T = \{1 - [(F_1 + F_o)/F_4]^2\}^{\frac{1}{2}} = 0.97979$$
$$C_5 = \{ [(F_1 + F_o)\,2\pi\,]^2 L_{wm}\}^{-1}$$
$$L_{wm} = \left(\frac{1}{L_1'} + \frac{1}{L_3}\right)^{-1} + L_2 = L_1 \text{ or}$$
$$C_5 = \left\{\left[(F_o + F_3)2\pi\right]^2 \left[\frac{1}{L_1'} + \frac{1}{L_3}\right]^{-1}\right\}^{-1}$$
$$L_4 = [(2\pi F_4)^2 C_5]^{-1}$$
$$C'_5 = C_5/m_T$$
$$L'_4 = L_4/m_T$$
$$C_6 = \{ [(F_1 + F_o)2\pi]^2 L'_4\}^{-1}.$$

Proof:

$$F_4 = (F_1 + F_2 + F_3) = 25F_1$$
$$F_4 = [(L_T \times C_T)^{\frac{1}{2}}]^{-1}$$
$$L_T = \left[\frac{1}{L_3} + \frac{1}{(L_2 + L_o)}\right]^{-1}$$
$$L_0 = \left[\frac{1}{L_1'} + \frac{1}{L_2 + L_3}\right]^{-1}$$
$$C_T = (C_2 + C_4 + C_5)$$

The interrelationships between the reactive elements of filter sections 20, 25, 30 is further shown by considering that:

$$C_5' = \left\{ L_T[2\pi\,(F_o + F_3)]^2 - \frac{1}{C_1'} \right\}^{-1}$$
$$L_4' = \{ \{ L_T[2\pi\,(F_o + F_3)]^2 \}^{-1}(2\pi F_4)^2 \}^{-1}$$
$$C_6 = [L_T(2\pi F_o)^2]^{-1}$$

The relationship between capacitor lock $C'_L$ and the reactive elements of filter sections 20, 25, 30 is seen from the following equations:

$$L_o = \left[\frac{1}{L_1'} + \frac{1}{L_2 + L_3}\right]^{-1}$$
$$'C'_L = [(F_1 + F_o)\,(F_4)\,(2\pi)^2\,L_o\,]^{-1}$$

The values calculated by using the foregoing equations may be verified by using the following checking equations wherein R, the measured speaker resistance, is equal to eight (8) ohms.

For woofer filter section 20:

$$L_1 = R/2\pi F_1$$
$$C_1 = 1/2\pi F_1 R$$
$$\text{constant } m_w = [1 - (F_1/F_2)^2]^{\frac{1}{2}} = 0.99215$$
$$L_1' = m_w L_1$$
$$C_1' = m_w C_1$$
$$C_2 = [(1 - m_w^2)/m_w]C_1$$

For midrange filter section 25:

$$C_3 = 1/(F_3 - F_1)2\pi R$$
$$L_2 = \frac{(F_3 - F_1)2\pi R}{(2\pi F_o)^2}$$
$$C_4 = \frac{(F_3 - F_1)2\pi}{(2\pi F_o)^2 R}$$
$$L_3 = R/(F_3 - F_1)2\pi$$

For tweeter filter section 30:

$$C_5 = \tfrac{1}{2}\,\pi\,F_4 R$$
$$L_4 = R/2\pi F_4$$
$$\text{constant } m_r = \{\,1 - [(F_1 + F_o)/F_4]^2\}^{\frac{1}{2}} = 0.97979$$
$$C_5' = C_5/m_T$$
$$L_4' = L_4/m_T$$
$$C_6 = [m_T/(1 - m_T^2)]C_5$$

In the above proofs, just as in the prior equations:

$F_1$=nominal starting frequency.

$F_2=8F_1$, $F_3=16F_1$, $F_0=(F_1 \times F_3)^{\frac{1}{2}}$ $F_4=F_1+F_2+F_3=25F_1$ For capacitor lock '$C'_L$:

$$F_1 + F_2 = F_4 - F_3$$
$$'C'_L = [(F_1 + F_2)2\pi(L_z/C_z)]^{-1}$$
$$L_z = \left(\frac{1}{L_1'} + \frac{1}{L_3}\right)^{-1} + \left(\frac{1}{L_2} + \frac{1}{L_4'}\right)^{-1}$$
$$C_z = \left(\frac{1}{C_1'} + \frac{1}{C_2}\right)^{-1} + \left(\frac{1}{C_3} + \frac{1}{C_4}\right)^{-1} + \left(\frac{1}{C_5'} + \frac{1}{C_6}\right)^{-1}$$

For systems where none of the speakers have a measured resistance of eight ohms, values for the filter elements required in each of the filter sections are found by utilizing multiply factors applied to values obtained by the foregoing equations for the $F_1$ system. More particularly, for each coil of filter sections 20, 25, 30 the multiplying factor is the measured resistance of the speaker fed by the filter section in question divided by eight (8); for each capacitor of filter sections 20, 25, 30 the multiplying factor is eight (8) divided by the measured speaker resistance; and for capacitor lock '$C'_L$ the multiplying factor is sixteen (16) divided by the sum of $R_w$ (measured resistance of woofer 12) and $R_m$ (measured resistance of midrange 13), or use:

$$'C'_L = \left[(L_o) \times \frac{R_w + R_m}{16} \times (2\pi)^2 \times (F_1 + F_o) \times (F_4)\right]^{-1}$$

where $L_0$ is from the $F_1$ system.

Thus, from the general equations, for the impedance elements of filter section 30 feeding tweeter 14 having a measure resistance $R_t$:

$$C_5' = \frac{C_5}{m_T} \times \frac{8}{R_t},$$
$$L_4' = \frac{L_4}{m_T} \times \frac{R_t}{8}, \text{ and}$$
$$C_6 = \{[(F_1 + F_o)2\pi\,]^2 L_4'\}^{-1} \times \frac{8}{R_t}.$$

Similarly the general equations for the impedance elements of filter sections 20 and 25 are obtained by applying appropriate multiplying factors to the values calculated for eight ohm speakers. Thus, $L'_1$ is multiplied by $R_w/8$, $C'_1$ and $C_2$ are each multiplied by $8/R_w$, $L_2$ and $L_3$ are each multiplied by $R_m/8$, and $C_3$ and $C_4$ are each multiplied by $8/R_m$.

For matched systems of other than eight ohms it is only necessary to establish the value of mathematical operator $L_1$ by applying the appropriate multiplying factor to the value of $L_1$ calculated for the $F_1$ system, then follow the other design equations.

Thus, it is seen that pursuant to the instant invention the reactive elements of all three filter sections 20, 25, 30 are interrelated in accordance with the preceding mathematical formulas which also relate these reactive elements to capacitor lock '$C'_L$.

It should now be apparent to those skilled in the art that because of practical considerations the values of the reactive elements utilized by a circuit designer to carry out the concepts of the instant invention may not be precisely those values obtained by solutions to the foregoing equations. However, without departing from the teachings of the instant invention, even though the values of the reactive elements of the crossover network may depart slightly from those values obtained from the precise mathematical solutions of those formulas previously discussed, the operational benefits of the instant invention may still be obtained.

Accordingly, although a preferred embodiment of this invention has been described, many variations and modifications will now be apparent to those skilled in the art, and it is therefore preferred that the instant invention be limited not by the specific disclosure herein, but only by the appending claims.

What is claimed is:

1. A high fidelity speaker system in combination with a filter network for coupling an audio amplifier to said speaker system for generating high fidelity signals over a predetermined audio frequency spectrum; said speaker system including a woofer for high fidelity reproduction of signals in a low frequency band of said spectrum at the low end thereof, a tweeter for high fidelity reproduction of signals in a high frequency band of said spectrum at the high end thereof, and a midrange for high fidelity reproduction of signals in a mid-frequency band of signals falling between said high and low frequency bands; said filter network including input terminals for operative connection to the output of an audio amplifier, a first section of said network having an input connected across said terminals and an output having said woofer connected thereacross, a second section of said network having an input connected across said terminals and an output having said midrange connected thereacross, and a third section of said network having an input connected across said terminals and an output having said tweeter connected thereacross, each of said sections including reactive element means connected in a predetermined circuit configuration, said reactive element means of said first section having a predetermined quantitative relationship with said relative element means of said second section, said reactive element means of said first and said second sections having a predetermined quantitative relationship with said reactive element means of said third section, and a lock capacitor means connected across said input terminals.

2. A speaker system and filter network combination as set forth in claim 1 in which there is a predetermined quantitative relationship between the capacitive lock and the reactive element means of said first, second and third sections; said predetermined quantitative relationship being expressed by mathematical formulas which include a term $F_1$, with the latter being a designer selected nominal starting frequency within said low frequency band of said spectrum.

3. A high fidelity speaker system in combination with a filter network for coupling an audio amplifier to said speaker system for generating high fidelity signals over a predetermined audio frequency spectrum; said speaker system including a woofer for high fidelity reproduction of signals in a low frequency band of said spectrum at the low end thereof, a tweeter for high fidelity reproduction of signals in a high frequency band of said spectrum at the high end thereof, and a midrange for high fidelity reproduction of signals in a mid-frequency band of signals falling between said high and low frequency bands; said filter network including input terminals for operative connection to the output of an audio amplifier, a first section of said network having an input connected across said terminals and an output having said woofer connected thereacross, a second section of said network having an input connected across said terminals and an output having said midrange connected thereacross, and a third section of said network having an input connected across said terminals and an output having said tweeter connected thereacross, each of said sections including reactive element means connected in a predetermined circuit configuration, said reactive element means of said first section having a predetermined quantitative relationship with said reactive element means of said second section, said reactive element means of said first and said second sections having a predetermined quantitative relationship with said reactive element means of said third section, said reactive element means of said first section including first and second capacitors and a first inductor, said first capacitor being connected across the output of the first section, said first inductor and said second capacitor connected in a parallel combination which is in series circuit between the input and output of the first section.

4. A speaker system and filter network combination as set forth in claim 3 in which the reactive element means of the third section includes fifth and sixth capacitors and a fourth inductor, said fourth inductor and said sixth capacitor being in a series combination connected across the output of the third section, said fifth capacitor being connected in series circuit between the input and output of the third section.

5. A speaker system and filter network combination as set forth in claim 4 in which the filter network also includes a lock capacitor means connected across said input terminals, and there is a predetermined quantitative relationship between the lock capacitor means and the reactive element means of said first, second and third sections, said predetermined quantitative relationship being expressed by mathematical formulas which include a term $F_1$, with the latter being a designer selected nominal starting frequency within said low frequency band of said spectrum.

6. A speaker system and filter network combination as set forth in claim 4 in which the reactive element means of the second section includes second and third inductors and third and fourth capacitors, said third capacitor and said second inductor being connected in a parallel combination connected across the output of the second section, said third inductor and said fourth capacitor being in a series combination connected in series circuit between the input and output of the second section.

7. A speaker system and filter network combination as set forth in claim 6 in which the first inductor ($L'_L$) is defined by the equation:

$$L_1' = \left[\left(\frac{F_2 - [F_3(F_1F_2)^{\frac{1}{2}}]^{\frac{1}{2}}}{F_1^2}\right) m_W\right] \times \left[\frac{R_w}{8}\right],$$

with $R_w$ being the measured resistance of the woofer and $m_W$ being a constant defined by the equation:

$$M_w = [1-(F_1/F_2)^2]^{\frac{1}{2}} = 0.99215,$$

in that $F_2 = 8F_1$ and $F_3 = 16F_1$; said first capacitor ($C'_1$) being defined by the equation:

$$C_1' = [(2\pi F_1)^2 \times L_1'/M_w]^- \times [M_w] \times [(8/R_w];$$

said second capacitor ($C_2$) being defined by the equation:

$$C_2 = [(2\pi F_2)^2 L_1']^{-1}[8/R_w];$$

and wherein $F_1$ is a designer selected nominal starting frequency.

8. A speaker system and filter network combination as set forth in claim 7 in which the third capacitor ($C_3$) is defined by the equation:

$$C_3 = \left\{ \{[F_1(F_3 - F_1)]^{\frac{1}{2}} 2\pi\}^2 \frac{L_1'}{m_W} \right\}^{-1} [8/R_m],$$

with the $R_m$ being the measured resistance of the midrange; said second inductor ($L_2$) being defined by the equation:

$$L_2 = [(2\pi F_o)^2 C_3]^{-1}[R_m/8]$$

wherein $F_0 = (F_1F_3)^{\frac{1}{2}}$; said fourth capacitor ($C_4$) being defined by the equation:

$$C_4 = \{\{[(F_0)^2/(F_3 - F_1)]2\pi\}^2 L_2\}^{-1} [8/R_m],$$

and said third inductor ($L_3$) being defined by the equation:

$$L_3 = [(2\pi F_o)^2 C_4]^{-1}[R_m/8].$$

9. A speaker system and filter network combination as set forth in claim 8 in which the fifth capacitor ($C'_5$) is defined by the equation:

$$C_5' = \left\{ [(F_1 + F_0)2\pi]^2 \frac{L_1'}{M_W} \right\}^{-1} \times \left[\frac{1}{M_T}\right] \times \left[\frac{8}{R_t}\right],$$

with $R_t$ being the measured resistance of the tweeter and $m_T$ being a constant defined by the equation:

$$m_T = \{1-[(F_1+F_0)/F_4]^2\}^{\frac{1}{2}} = 0.97979$$

in which $F_4 = (F_1+F_2+F_3) = 25F_1$; said fourth inductor ($L'_4$) being defined by the equation:

$$L_4' = [(2\pi F_4)^2(C_5' \times m_T)]^{-1}[(1/m_T)][(R_t/8)]$$

and said sixth capacitor ($C_6$) being defined by the equation:

$$C_6 = \{[(F_1+F_0)2\pi]^2 L'_4\}^{-1}[8/R_t].$$

10. A speaker system and filter network combination as set forth in claim 9 in which the filter network also includes a lock capacitor means connected across said input terminals; said lock capacitor means comprising a capacitor ('$C'_L$) defined by the equation:

$$'C'_L = [(F_1+F_0)(F_4)(2\pi)^2 L_0]^{-1},$$

where, from the $F_1$ system:

$$L_0 = \left[\frac{1}{L_1'} + \frac{1}{L_2 + L_3}\right]^{-1}$$

and then when then the sum of the woofer and midrange resistances (Rw+Rm) is not 16 ohms, said Lo above is to be multiplied by (Rw+Rm)/16.

11. A speaker system and filter network combination as set forth in claim 3 in which the first inductor ($L'_1$) is defined by the equation:

$$L_1' = \left[\left(\frac{F_2 - [F_3(F_1F_2)^{\frac{1}{2}}]^{\frac{1}{2}}}{F_1^2}\right) m_W\right] \times \left[\frac{R_w}{8}\right],$$

with $R_w$ being the measure resistance of the woofer and $m_W$ being a constant defined by the equation:

$$m_w = [1-(F_1/F_2)^2]^{\frac{1}{2}} = 0.99215,$$

in that $F_2 = 8F_1$ and $F_3 = 16F_1$; said first capacitor ($C'_1$) being defined by the equation:

$$C_1' = \left[(2\pi F_1)^2 \times \frac{L_1'}{M_W}\right]^{-1} \times [M_W] \times \left[\frac{8}{R_w}\right];$$

said second capacitor ($C_2$) being defined by the equation:

$$C_2 = [(2\pi F_2)^2 L_1']^{-1}[8/R_w];$$

and wherein $F_1$ is a designer selected nominal starting frequency; said filter network also including lock capacitor means connected across said input terminals.

12. A high fidelity speaker system in combination with a filter network for coupling an audio amplifier to said speaker system for generating high fidelity signals over a predetermined audio frequency spectrum; said speaker system including a woofer for high fidelity reproduction of signals in a low frequency band of said spectrum at the low end thereof, a tweeter for high fidelity reproduction of signals in a high frequency band of said spectrum at the high end thereof, and a midrange for high fidelity reproduction of signals in a mid-frequency band of signals falling between said high and low frequency bands; said filter network including input terminals for operative connection to the output of an audio amplifier, a first section of said network having an input connected across said terminals and an output having said woofer connected thereacross, a second section of said network having an input connected across said terminals and an output having said mid-range connected thereacross, and a third section of said network having an input connected across said terminals and an output having said tweeter connected thereacross, each of said sections including reactive element means connected in a predetermined circuit configuration, said reactive element means of said first section having a predetermined quantitative relationship with said reactive element means of said second section, said reactive element means of said first and said second sections having a predetermined quantitative relationship with said reactive element means of said third section, said reactive element means of said third section including fifth and sixth capacitors and a fourth inductor, said fourth inductor and said sixth capacitor being in a series combination connected across the output of the third section, said fifth capacitor being connected in series circuit between the input and output of the third section.

* * * * *